US006135047A

United States Patent [19]

Miller

[11] Patent Number: 6,135,047

[45] Date of Patent: Oct. 24, 2000

[54] KIT FOR NON-PERMANENTLY CONVERTING A STAND UP PWC INTO A SIT DOWN

[76] Inventor: Scott A. Miller, 4510 Country Club Dr., Shelby Twp, Mich. 48316

[21] Appl. No.: 09/187,603

[22] Filed: Nov. 6, 1998

[51] Int. Cl.[7] ..... B63B 17/00

[52] U.S. Cl. ..... 114/343; 114/55.5; 114/55.55; 114/55.57; 114/248; 114/259; 441/72

[58] Field of Search ..... 114/55.5, 55.54, 114/55.55, 55.57, 123, 248, 259, 283, 343; 441/72

[56] References Cited

U.S. PATENT DOCUMENTS

| | | | |
|---|---|---|---|
| 3,702,106 | 11/1972 | Wilder | 115/70 |
| 4,320,713 | 3/1982 | Nishida | 114/123 |
| 4,694,770 | 9/1987 | Kitner et al. | 114/123 |
| 4,754,724 | 7/1988 | Murakami et al. | 114/363 |
| 5,117,764 | 6/1992 | Kretzer | 114/361 |
| 5,184,564 | 2/1993 | Robbins | 114/270 |
| 5,255,625 | 10/1993 | Hattori | 114/248 |
| 5,282,437 | 2/1994 | Basto | 114/345 |
| 5,353,730 | 10/1994 | Talbot | 114/248 |
| 5,443,028 | 8/1995 | Keen | 114/248 |
| 5,605,110 | 2/1997 | Talbot | 114/248 |
| 5,685,254 | 11/1997 | Jacques | 114/361 |
| 5,746,150 | 5/1998 | Beaulac | 114/248 |

*Primary Examiner*—S. Joseph Morano
*Assistant Examiner*—Ajay Vasudeva

[57] ABSTRACT

A hull and seat assembly configured to be easily installed, secured and operated on production stand up PWC. The hull assembly (21) increases buoyancy and stability sufficient for multi-rider sit down operation while maintaining peak performance geometry. The arrangement of the hull provides rider foot wells (30,31), allows it to be fabricated and installed in one piece, and provides unobstructed water jet flow and turning capability. The seat assembly (81) provides a tandem seat for multiple riders, positions the handle pole and provides a platform (29) that eases boarding from deep water. The seat assembly fills the stand up foot well and extends rear of the transom for increased longitudinal stability. Storage space is provided in both the hull (53) and seat assemblies (66). The connection strategy concurrently secures the hull (21), seat (81) and PWC (26) together with one releasable fastener (70) and is arranged to be fail safe.

17 Claims, 10 Drawing Sheets

KIT FOR NON-PERMANENTLY CONVERTING A STAND UP PWC INTO A SIT DOWN

BACKGROUND

1. Field of the Invention

Figure 1:
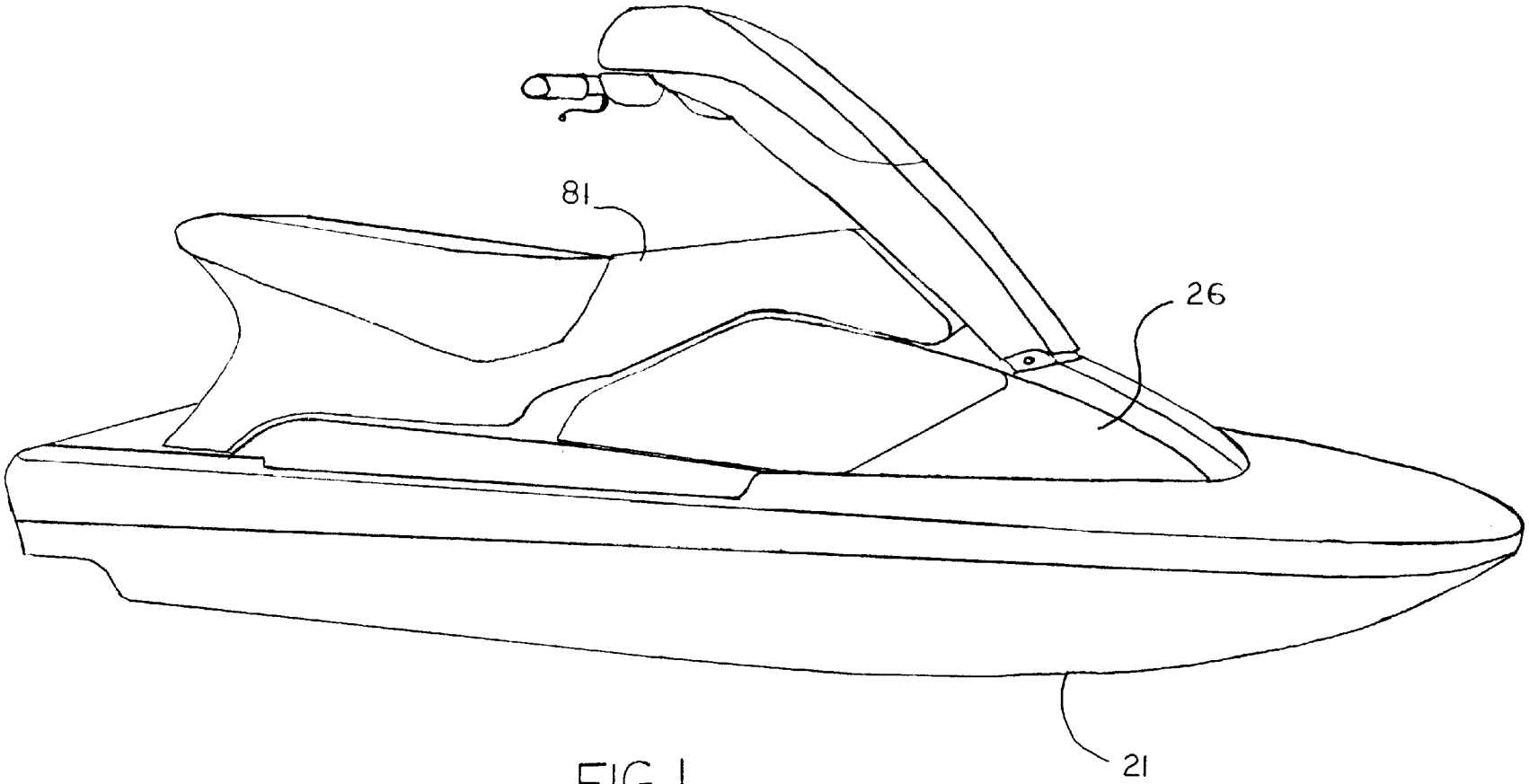

This invention relates to PWC, specifically to a kit for non-permanently converting a stand up PWC into a sit down.

2. Background—Prior Art

Currently, Personal Watercraft (PWC) consist of three primary classifications. There are single person "stand ups", 2 and 3 rider "sit downs", and sit in "jet boats" with seating for 3 or more passengers. Although all are classified as PWC, each has its own distinct advantages and disadvantages. Single person stand up skis are the smallest PWC, have the least utility and are widely regarded as the most difficult to ride. The hull is designed with minimum roll and longitudinal stability which enables extreme maneuverability. At low speeds, even average size riders must hang over the stern to remain upright. At planing speeds, riders must quickly shift their body weight, and therefore the overall Center of Gravity (CG), to maintain directional control and keep the nose from submerging. All stand up PWC have an open footwell and pivoting handle pole to allow maximum freedom for the above maneuvers.

Jet boats do not require the driver to shift his weight for control, have the largest payload capacity, and offer a statically stable platform for activities such as fishing or sunbathing. Multi-person sit down skis are positioned between stand ups and jet boats with regard to stability vs. control or utility vs. maneuverability capabilities. Their size and configuration limit the operator's ability to affect the overall CG for control purposes. Therefore, sit down skis have greater stability design requirements then stand up skis. For example, the bow of a sit down ski is enlarged to prevent submerging due to elevated pitch loads created by seated riders. Also, they have increased roll and longitudinal stability to permit low speed handling from a seated position and reduce deep water boarding difficulty.

Sit down skis have become the most popular selling class by having a popular ratio of thrill and utility. This ratio has been achieved mainly by engine performance enhancements. Until now, consumers that want the ultimate maneuverability of a stand up and the utility of a sit down must buy one of each. This option is not popular since owning two PWC doubles maintenance, storage, trailer capacity and operating cost. Additionally, one of the skis must be left behind when going on trips.

A search of the prior art did not disclose any patents that address the requirements for non permanently converting a stand up into a sit down type PWC. However, the following patents are related and indicative of the state of the art. U.S. Pat. Nos. 5,746,150, 5,443,028, and 5,353,730 each provide a structure, sized and arranged similar to a small boat, that uses a PWC for propulsion. These designs provide a docking bay or bays at their rear that allows a PWC to be inserted and temporarily secured. The combination forms a jet boat class vessel with a passenger area and overall CG located forward of the docked PWC. The main requirement of the attachment interface is to securely couple the two units in a fashion that allows easy removal and integration with many different PWC brands and models. The size and arrangement of these designs alleviates the necessity to address the unique stability, performance and ergonomic requirements for converting a stand up ski into a sit down.

U.S. Pat. No. 5,685,254 provides a permanently attached second hull that makes stand up PWC easier to ride for full sized adults. A seat is not provided nor is any means to fix the handle pole. The second hull provides a limited increase in stability by enlarging the PWC bottom and 4 sides. The configuration requires a secondary ride plate and jet nozzle extension due to interference with the water jet operation. Also, the structure requires modification of the PWC and tools for installation.

U.S. Pat. No. 4,694,770 provides a multi-piece hull that simplifies the low speed handling of stand up PWC. Application of the structure leaves the footwell and handle pole unrestricted so that stand up operation is uninhibited. The structure improves roll stability by extending the lateral hull surface in contact with the water. The structure does not extend the hydrodynamic bow of the PWC and cannot extend rearward past the PWC transom without restricting the water jet turning effectiveness. Therefore, longitudinal stability is limited by the length of the PWC and insufficient for multiple sit down riders. Additionally, the location of the hull separations increases drag sensitivity due to fit variation and renders the vehicle inoperable should an attachment fail or become lost overwater. Finally, the chair configured across the stern prohibits operating with multiple riders and is restrictive for deep water boarding.

As discussed above, stand up PWC do not have the buoyancy, stability or structure to support multiple seated riders and no prior art addresses these requirements with a non permanently applied kit. In addition to increasing buoyancy and stability, such a design must satisfy unique ergonomic, installation, manufacturing and packaging requirements. Extensive research, development and testing has been completed with a prototype kit to ensure the following invention satisfies all of these requirements while maximizing performance with an inherently fail safe design.

OBJECTS AND ADVANTAGES

Accordingly, several objects and advantages of the present invention are:

a. to provide a kit that increases buoyancy and stability for stand up PWC sufficient to be operated as a sit down PWC with multiple riders while maintaining optimum geometry for peak performance.

b. to provide a kit that can be easily installed on a non modified stand up PWC with minimum pieces and attachments.

c. to provide a hull that allows one piece installation on elliptical shaped PWC and can be manufactured with fewer molds.

d. to provide a hull that extends the bow of a stand up PWC with minimum water flow disruption.

e. to provide a hull that can be contoured to provide specific static and dynamic performance characteristics.

f. to provide a hull that extends buoyancy behind the transom of stand up PWC without impeding water jet flow or turning capability.

g. to provide a seat assembly that comfortably seats multiple riders in tandem.

h. to provide a seat assembly that fills the stand up foot well, increasing buoyancy, while providing hand access to controls.

i. to provide a seat assembly that supports the handle pole for sit down riding.

j. to provide a seat assembly that provides righting floatation when the PWC is overturned.

k. to provide a seat assembly that provides storage space.

l. to provide a seat assembly that assists deep water boarding.

m. to provide a seat assembly that can mount a thrust reversing system or retractable boarding step.

n. to provide a kit that can be manufactured with common PWC materials and processes.

o. to provide a fail safe attachment strategy.

p. to provide an attachment strategy that minimizes dimensional tolerance requirements q. to provide an attachment strategy that concurrently fastens the hull, seat and PWC securely together with minimum fasteners.

Further objects and advantages are to provide a kit that can be installed and removed by an average person without the use of tools or lifting devices and will not damage the stand up PWC when used. Additional objects and advantages will become apparent from a consideration of the ensuing description and drawings.

DRAWING FIGURES

1. Right Front ISOMETRIC
2. Exploded view of kit with PWC
3. Lateral cross section taken along lines 3—3 in FIG. 4
4. Transparent side view showing hull extension step
5. Longitudinal Center line section
6. Top view of hull with PWC silhouette staged for installation
7. Top view of hull with PWC silhouette fully inserted
8. Left Rear ISOMETRIC
9. Transparent side view of second embodiment
10. Lateral section of second embodiment taken along lines 10—10 in FIG. 9

DESCRIPTION—MAIN EMBODIMENT

A typical embodiment of the present invention is illustrated in FIGS. 1–8. In the preferred embodiment, the kit consists of a hull assembly 21, a seat assembly 81, and an over center type fastener 70. Application of the kit requires no modification to the PWC 26.

Figure 2:
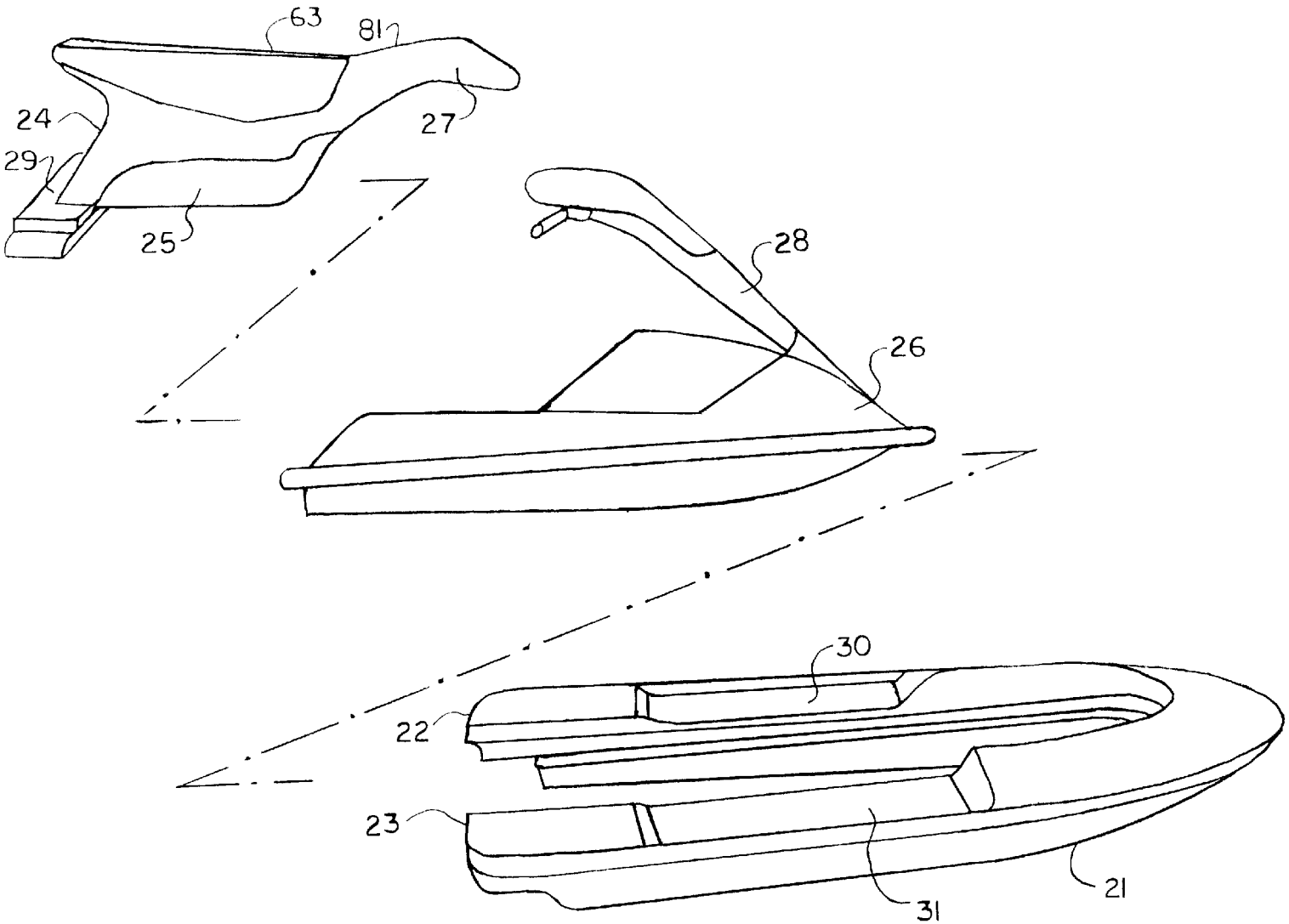

The hull assembly 21, shown in FIG. 2, has a length/width ratio of approximately 2, which is similar to conventional sit down PWC. The hull extends around the front, partially under the bow and along the left and right sides of the stand up PWC forming left 22 and right 23 side pods. FIG. 2 shows the seat assembly 81 which includes a base 24 and a padded seat 63. A portion of the seat base 25 fits into and fills the PWC foot well. The seat extends forward 27 to support the PWC handle pole 28 and extends rearward forming a rear deck 29. Riders are seated in tandem behind the PWC handle pole 28 with their feet supported in foot wells 30,31 provided on the top surface of each hull side pod. The unmodified handle pole 28 locates the seated riders resulting with an overall higher and rearward composite CG.

Figure 3:
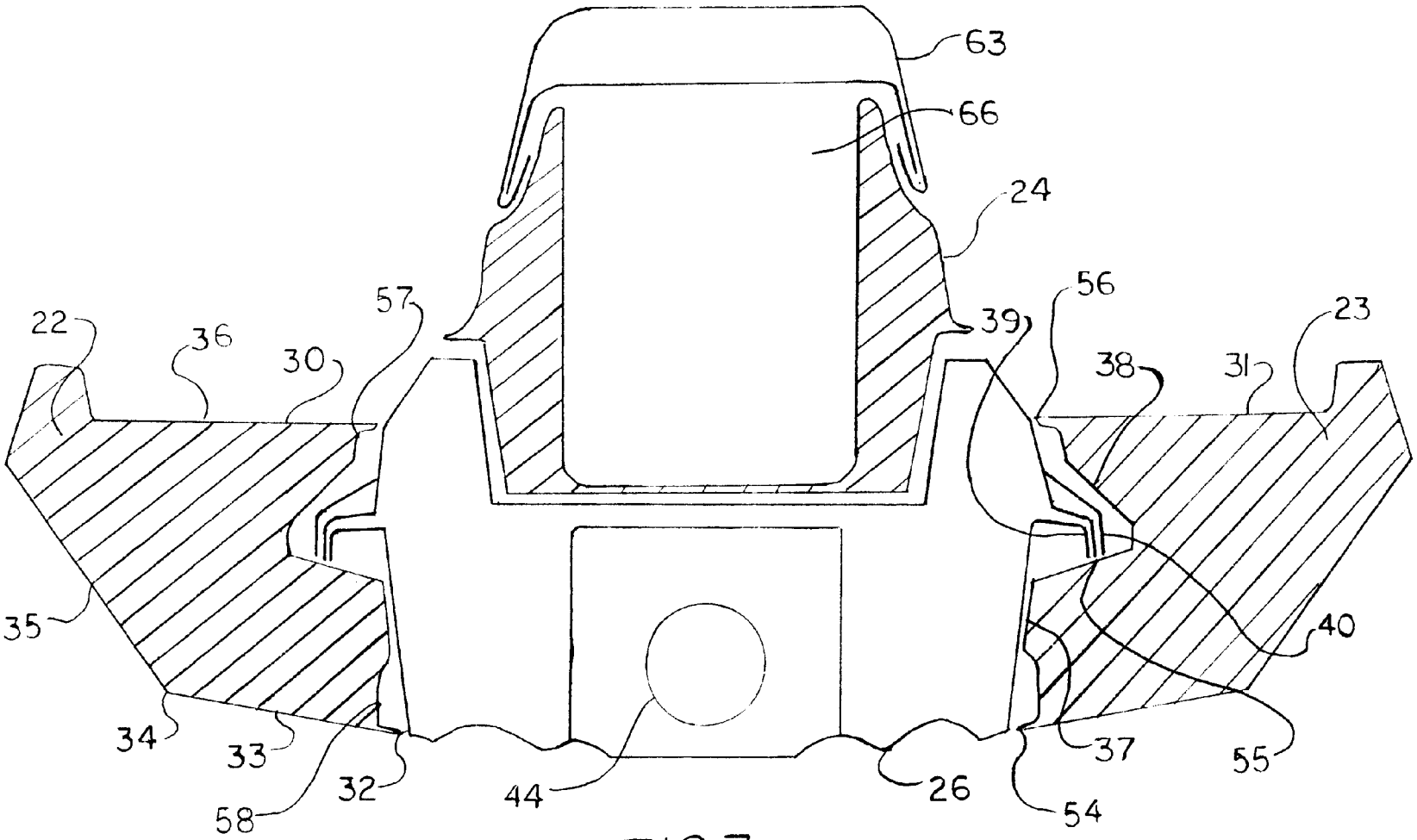
Figure 4:
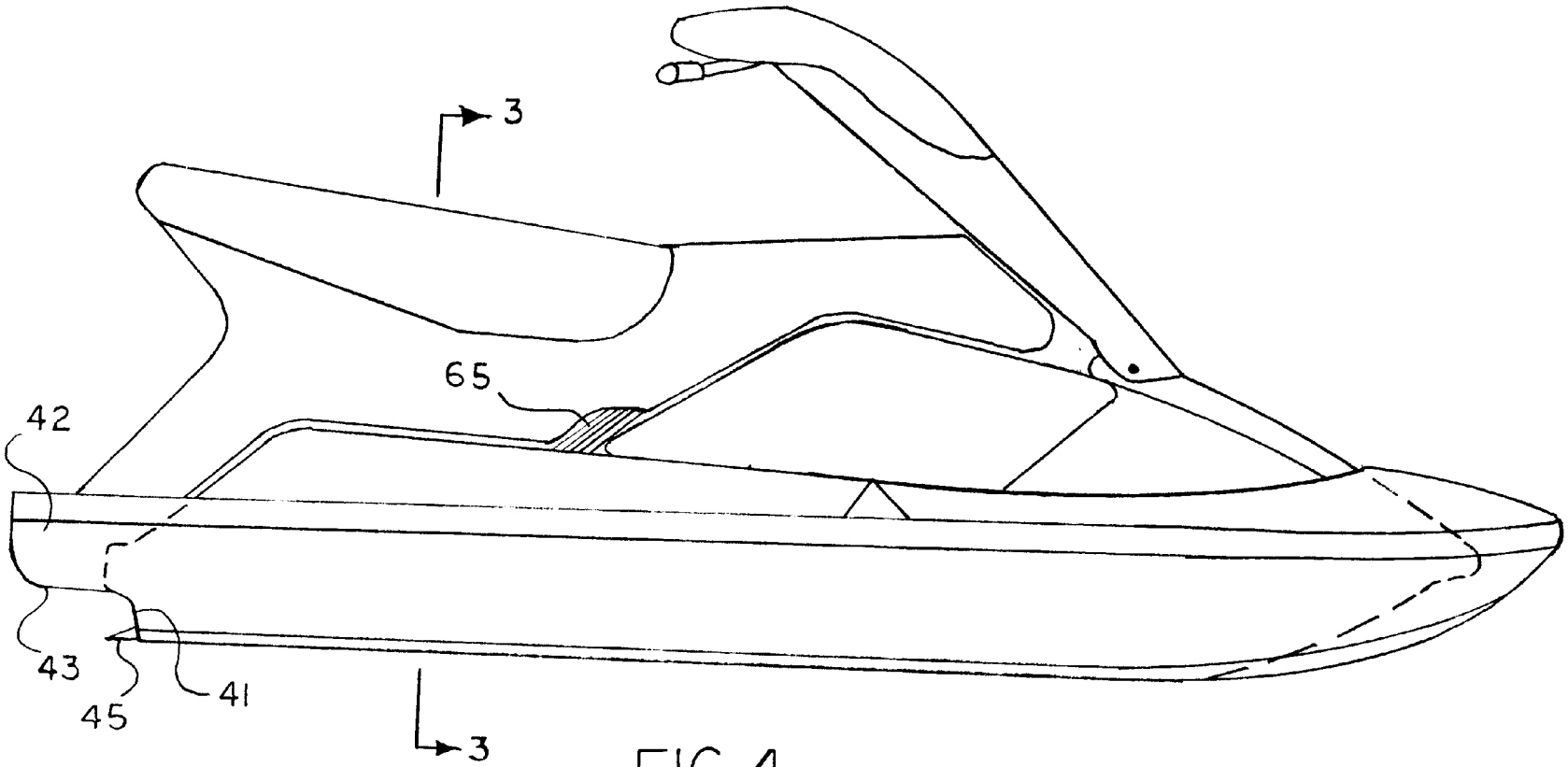

FIG. 3 shows a lateral section through the seat assembly 81 and left and right side pods 22,23. The side pods are symmetric and extend outboard from the bottom corner of the PWC side 32 forming a bottom surface 33, chine 34, outer side 35 and top surface 36. This section is mostly continuous from front to rear, except for changes to conform to the PWC top and side profiles and the foot well pockets 30,31. When installed on the PWC, the combination forms a modified V hull as best shown in FIG. 3. Longitudinal stability requirements, calculated with the composite CG location, determine the side pod section minimum area. The angle of the bottom surface 33 is typically between 15–30 degrees. Higher angles provide sharp turning and better rough water performance, while lower angles provide better acceleration and top speed. Roll stability requirements determine the width of the side pod sections and the outer side 35 tumble home angle. For sufficient longitudinal stability, the hull side pods 22,23 extend past the stand up transom 41 forming rear extensions 42, as shown in FIG. 4. The bottom surface 43 of each extension 42 is elevated above the PWC water jet exit 44 (FIG. 3) to prevent them from impeding the water jet blast during turning maneuvers. Also, the step arrangement provides a surface to mount trim tabs 45 for adjustable dynamic trim control.

Figure 5:
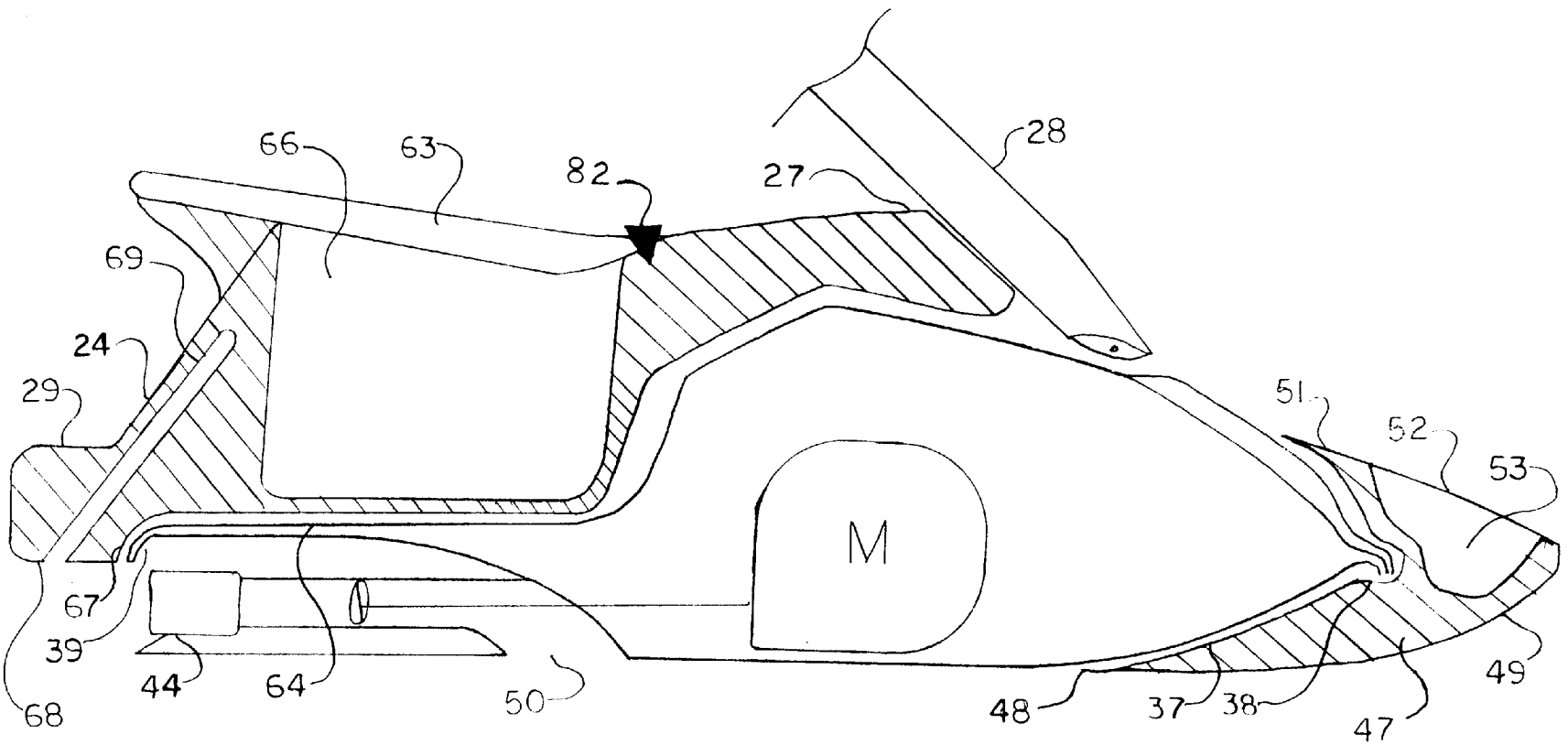

FIG. 5 shows a longitudinal section at the centerline. The front section 47 is sized to prevent the bow from submerging due to multiple seated rider pitch loads. The front section 47 extends forward from the lowest point of the PWC hull 48 and then turns upward 49. This arrangement creates a smooth transition that extends the front of the hull with minimum water flow disruption under pitch conditions. This arrangement also minimizes flow disruption to the PWC water jet inlet 50 and the need for additional water jet structure. A top surface 51 extends back to the top deck of the PWC. A removable door 52 and cavity 53 are provided for additional storage.

As shown in FIGS. 3 and 5, the inner surface 37 of the hull is contoured to closely fit the outside surface of the PWC and has an integral clearance channel 38 formed around the PWC bond Flange 39 and bond flange bumper 40. The hull 21 to PWC 26 interface strategy is to create three contact surfaces 54, 55, 56 that transmit forces directed up and inboard by the shape of the hull bottom 33 and sides 35. Vertical forces are transmitted from the horizontal surface 55 to the bottom of the PWC bond flange 39. Horizontal forces are transmitted along the inner surface top 56 and bottom 54 edges to the PWC top deck and hull respectively. Recesses 57,58 are provided for installation of elastomeric bumpers to prevent damage between the structure and PWC. To allow the PWC to be slidably inserted from the rear, the clearance channel 38 is sized larger than any respective bond flange bumper 40 section found forward of its installed position. Additional recesses and drain paths (not shown) are provided for engine water ports and for those stand ups' with side exit exhaust.

Figure 6:
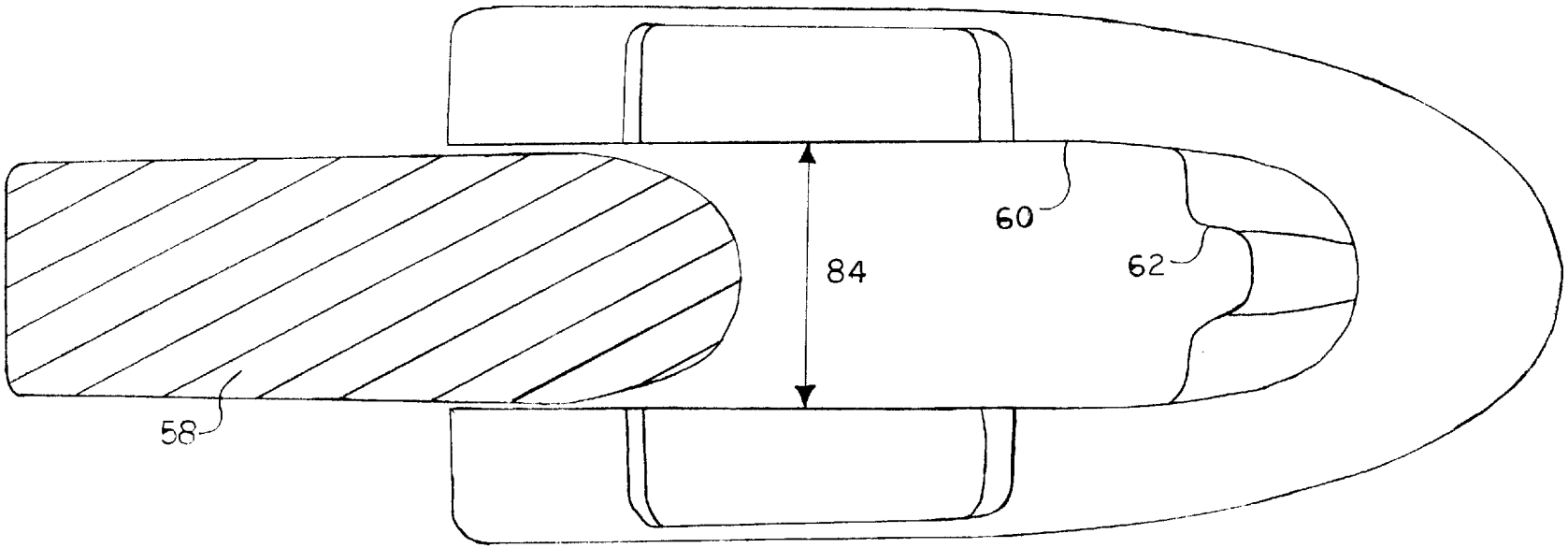
Figure 7:
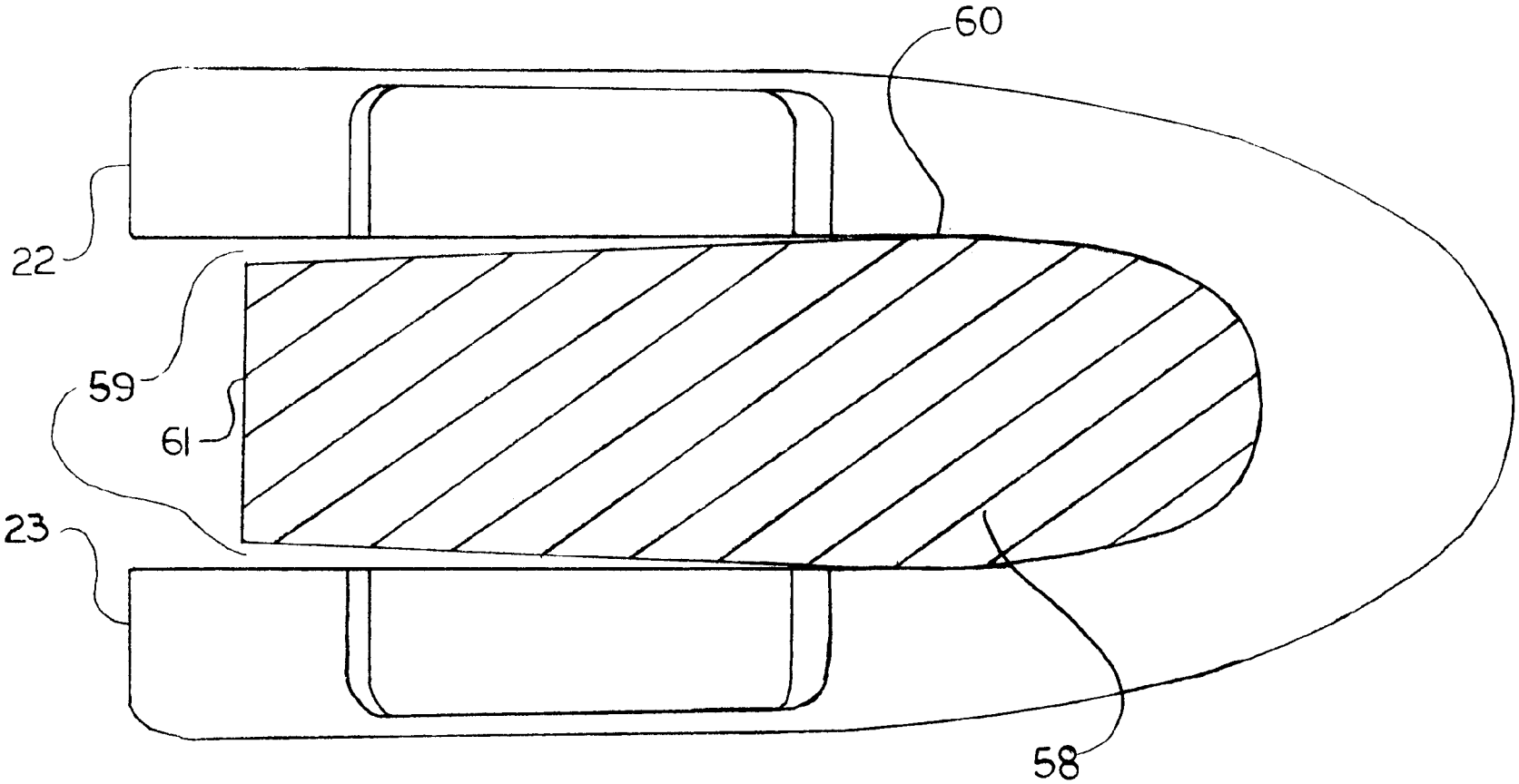

As shown in FIG. 6, the hull is manufactured so that the minimum opening 84 between the left and right side pods is greater then the maximum width of an elliptical PWC 58. This feature provides two benefits. First it allows the hull assembly 21 to be installed in one piece. Second, it allows a single axis die pull direction that greatly simplifies manufacturing by reducing the number molds. As shown in FIG. 7, an increasing gap 59 will be created between the hull side pods 22,23 and the PWC 58 from the point of maximum width 60 to the transom 61 of the PWC. When the attachment strap 70 is tightened, the side pods flex inboard and the gap is eliminated. Referring back to FIG. 6, to provide lateral flexibility the bow bottom surface 62 does not extend beyond the maximum width point 60. The gap length/width ratio is well within the material flexibility specifications of all common PWC material. This object allows the hull to be manufactured using two molds with a longitudinal die pull axis. Referring back to FIG. 3, the first mold extends from the left rear around the front to the right rear and includes the bottom surface 33, the outer side surface 35 and the top surface 36. A slide type feature is included in the mold for the formation of the foot wells 30,31. The second mold includes the inner surface 37 and the right and left transoms. In the preferred embodiment, the hull is rotomolded in one piece, using thermoplastic material, by combining the first and second molds. The hull is then filled with a polyurethane foam for structural support and unsinkable floatation. Other materials, such as a sheet molded composite, RTC, or fiberglass can be used with conventional molds, however an additional bonding step is required.

As shown in FIGS. 2, 3, and 5, the seat assembly consist of a base 24 and a rectangular padded seat 63 oriented for tandemly seated riders. The seat base 24 fits snugly into and rests on the bottom of the PWC foot well 64. The seat base 24 largely fills the PWC foot well except for a recess 65 (see FIG. 4) provided on the left and right sides for hand access to the PWC controls. As shown in FIG. 5, the padded seat is secured to the base with a releasable latch 82 and the seat base has a cavity underneath 66 for storage. The seat base 24 extends forward and above the PWC engine cover to form a support 27 for the PWC handle pole 28 in a desired position for sit down riding. The seat base extends rearward to form a rear deck 29 behind and parallel to the PWC transom. The rear deck is contoured 67 to fit snugly around the PWC bond flange 39 providing a fore/aft stop for the seat assembly. The rear deck length, width and height are sized to fit flush between the rear hull extensions. The bottom surface 68 of the rear deck is above the PWC water jet exit 44 and exhaust port (not shown). The seat assembly is constructed to be buoyant adding longitudinal stability and to provide righting forces for when the vessel is overturned. Additionally, the rear deck 29 provides a structure to mount a retractable ladder 69 or thrust reversing bucket (not shown).

Figure 8:
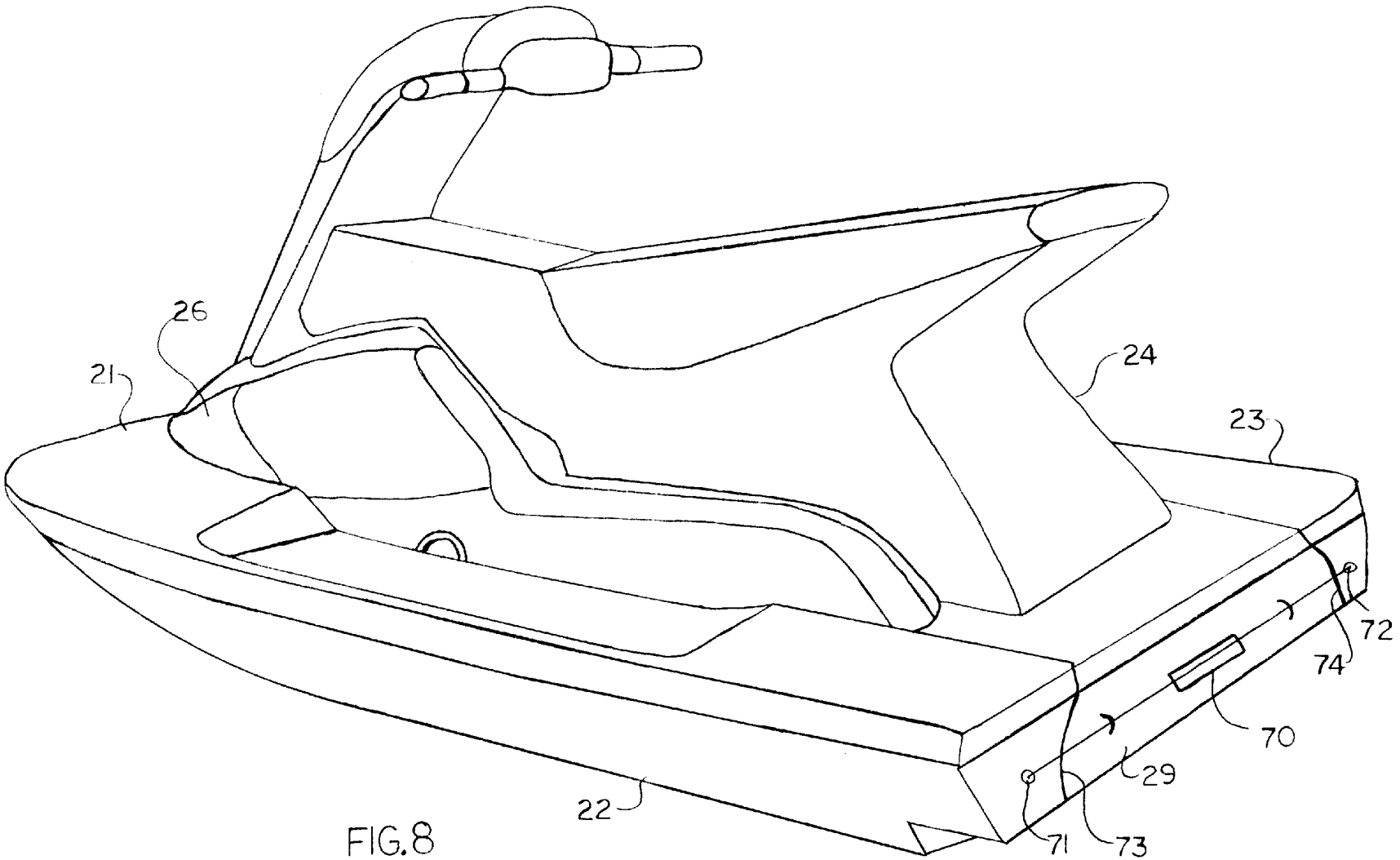

As shown in FIG. 8, the attachment strategy secures the seat base 24, hull assembly 21 and PWC 26 together with a tension type releasable strap 70. The strap 70 is loosely attached to the rear deck 29 with freedom to move left or right. The strap 70 has hooks on each end and an eyelet 71,72 is attached to each hull side pod transom. When the strap 70 is tightened, the side pods are drawn inboard, thereby eliminating the hull/PWC gap 59. Mating surfaces 73,74 between the seat assembly and the hull extensions are contoured to create opposing forces. The mating surfaces on the seat base 73,74 are curved inboard from bottom to top and extend under the rear hull extensions. Corresponding surfaces on the hull rear extensions 73,74 extend outboard from top to bottom. Tightening the tension strap 70 pulls the side pods 22,23 inboard against the side of the PWC. The reaction forces created by the inboard motion of the side pods against surfaces 73,74 directs the seat assembly against the PWC footwell 64 and rear bond flange 39. Concurrently, the hull clearance channel surface 55 is directed against the bottom edge of the PWC bond flange 39, simultaneously interlocking the seat assembly, the hull assembly and the PWC securely together. And finally, locating the attachment interface at the rear of the vehicle minimizes water flow disruption due to imperfect fit and provides fail safe operation should the tension strap 70 separate during operation.

This seat base 24 is manufactured using two molds having a vertical die pull axis. The exposed seat base side surfaces, mating surfaces 73,74 and the storage cavity 66 are fabricated with one mold. The seat base bottom and sides 25 that fill the footwell are created in a second mold. In the preferred embodiment, the seat base is rotomolded in one piece, using thermoplastic material, by combining the first and second molds. Other materials, such as a sheet molded composite, RTC, or fiberglass can be used with conventional molds, however an additional bonding step is required.

SUMMARY OF INVENTION

In accordance with the present invention, a kit for non-permanently converting a stand up into a sit down PWC comprises a hull and seat assembly configured to be easily installed, secured and operated on production stand up PWC. The hull assembly increases buoyancy and stability sufficient for multi-rider sit down operation while maintaining peak performance geometry. The arrangement of the hull provides rider foot wells, allows it to be fabricated and installed in one piece, and provides unobstructed water jet flow and turning capability. The seat assembly provides a tandem seat for multiple riders, positions the handle pole and provides a platform that eases boarding from deep water. The seat assembly fills the stand up foot well and extends rear of the transom for increased longitudinal stability. Storage space is provided in both the hull and seat assemblies. The connection strategy concurrently secures the hull, seat and PWC together with one releasable fastener and is arranged to be fail safe.

OPERATION—MAIN EMBODIMENT

Operation consist of installing, operating and removing. The preferred embodiment allows installation by one person without the use of tools, special equipment or modification to the PWC. Either the seat 81 or hull 21 assembly can be installed first. The hull 21 is installed by positioning it in front of the stand up PWC, aligning the inner surface clearance channel 38 with the PWC bond flange 39 and then sliding rearward. The configuration of the present invention allows hull installation to be completed when the PWC is on the ground, trailer or while floating. The seat assembly 81 is installed by simply setting it into the foot well of the PWC and sliding it forward until it contacts the PWC bond flange. For convenience, the handle pole 28 should be temporarily fixed upright.

After the hull and seat assemblies are installed, the connection strap 70 is attached to the left 71 and right 72 hull transom eyelets 71,72. Then tension is applied to the connection strap 70 pulling the hull side pods 22,23 inboard. The inboard motion and geometry between the rear deck and hull extensions 73,74 pulls the hull rearward and up and the seat forward and down, consequently interlocking the hull, seat and PWC securely together with one attachment.

Once the kit is installed the combination is ready for operation. The PWC steering, throttle, fuel, choke and on/off controls remain unchanged. Hand access to controls located on the forward wall of the PWC footwell is provided through a recess 65 on the left and right sides in the seat assembly. Boarding from deep water is best accomplished over the stern. The rear deck 29 provides an intermediate boarding surface reducing the distance riders must climb from the water to the seat in one motion. For additional boarding convenience, a cavity is provided for installation of a retractable step. Grab handles can be provided on the seat cushion or on the side of the seat assembly. Removal of the kit is in reverse order of installation. Removal can be accomplished while the combination is on the ground, trailer or while floating.

OTHER EMBODIMENTS

Figure 9:
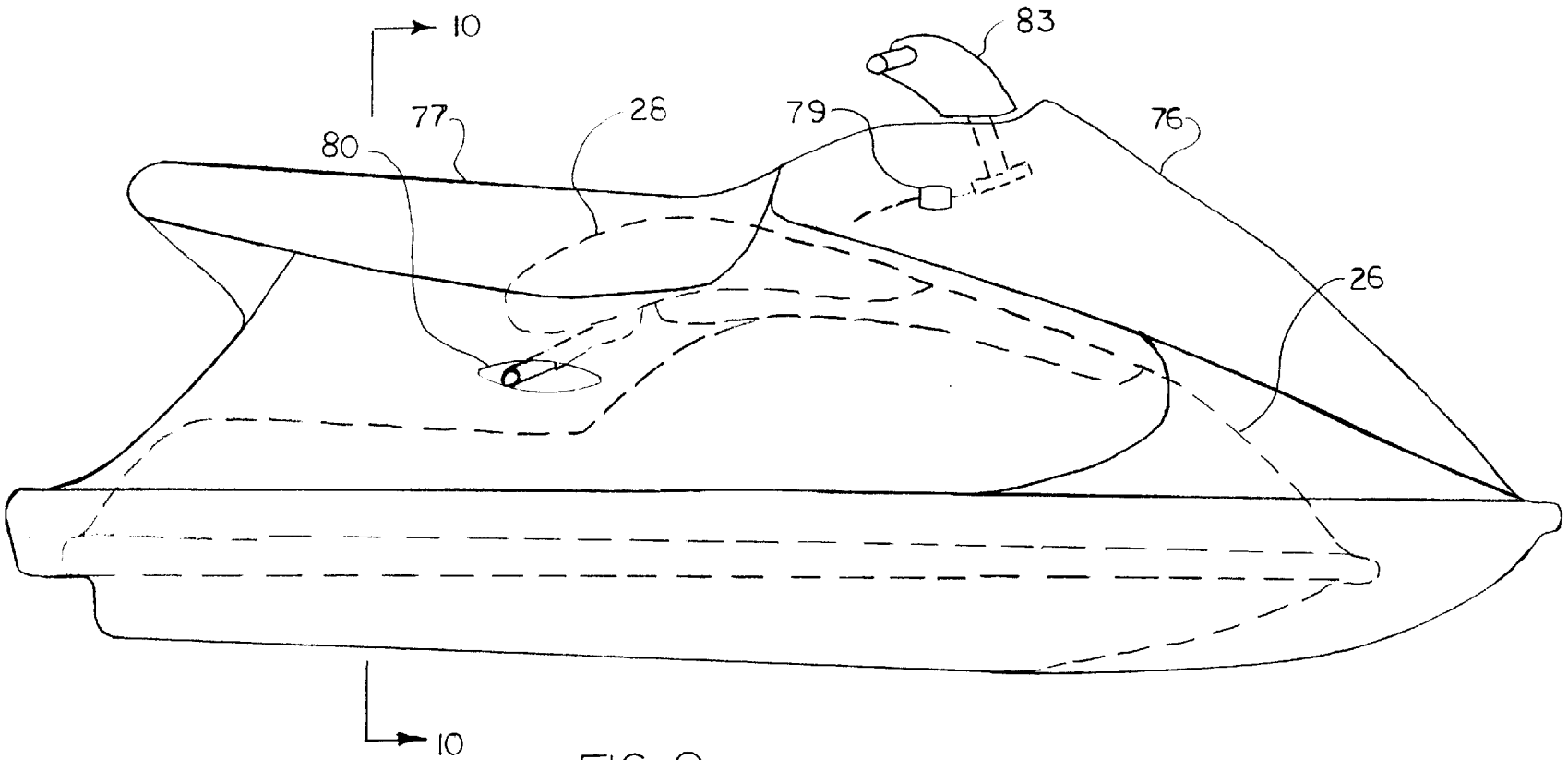
Figure 10:
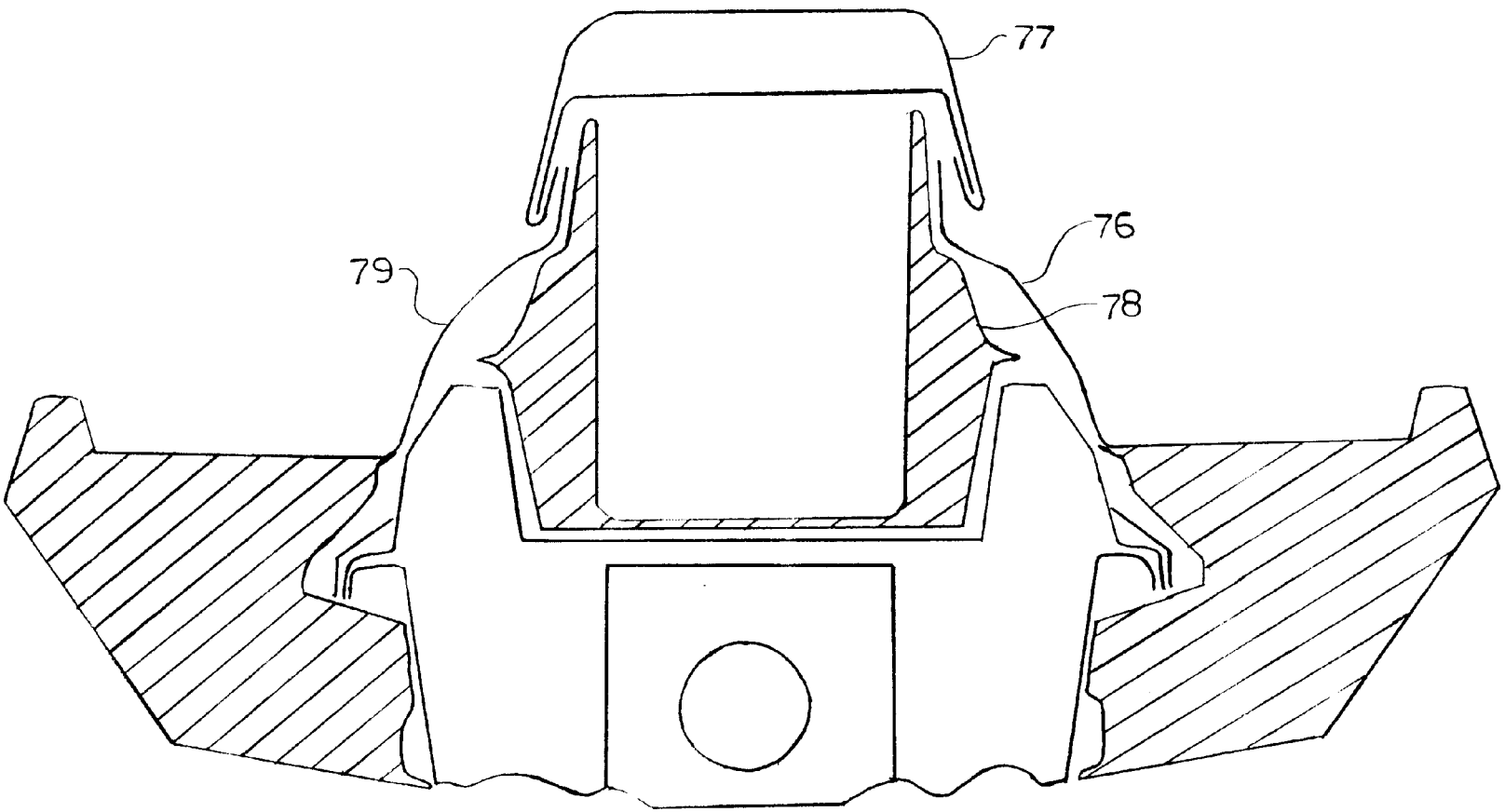

Another embodiment is shown in FIGS. 9 and 10. This embodiment has a larger top shell 76 that extends over the top of the stand up PWC 26. The stand up PWC handle pole 28 remains in it's down position and a longer seat 77 extends over top. This embodiment requires a second steering and throttle control system 83 and quick connect linkages 79 to the PWC handle bar and throttle control lever. Hand access passages 80 on each side provide access to the start/stop switch and footwell controls. As shown in FIG. 10, the rear part of the top shell 76 is nested in a pocket formed between the removable padded 77 seat and a smaller seat base 78. The rear part of the top shell 76 is flared outboard 79 to clear the PWC handle pole and engine cover during installation. Some seat base storage space is lost due to the location of the PWC handle pole, however, more space is available up front. For operation, the hull must be installed before the seat assembly to allow connection of the steering linkage and to assure the hull sides are nested when the seat assembly is installed.

CONCLUSION

Accordingly, the reader will see that the kit for non-permanently converting a stand up PWC into a sit down of this invention provides an alternative use for stand up PWC. The kit can be easily installed, while on land or water, without tools or modification to the stand up PWC. The kit provides a stable and safe sit down PWC that can carry up to 3 riders with maximum performance. The hull design provides one piece installation while minimizing the investment and labor to manufacture. The seat design provides a comfortable seat that also inproves storage, eases deep water boarding, and increases buoyancy. The connection strategy is a fail safe design that requires a minimum number of fasteners to positively secure the hull assembly, seat assembly, and stand up PWC together.

Although the description above contains many specificities, these should not be construed as limiting the scope of the invention, but as merely providing illustrations of some of the presently preferred embodiments of this invention. For example, the hull can have other shapes, such as multi chine, stepped bottom, oval, circular, etc.; the hull and seat mating surfaces can be arranged laterally, horizontally or have other geometry such as planar surfaces, etc. Thus the scope of the invention should be determined by the appended claims and their legal equivalents, rather then by the examples given.

I claim:

1. A kit for use in combination with a stand up PWC, said stand up PWC comprising a water jet inlet, water jet exit, water jet propulsion means, hull, top deck, bond flange between said hull and top deck, foot well, and pivotably mounted handle pole, whereby resulting combination of said kit and stand up PWC functions as a sit down PWC, said kit comprising:

a. a seat assembly comprising a rectangular base with a rectangular seating surface mounted on top, said base having an exterior width slightly smaller than the interior width of said stand up PWC foot well and height greater than the depth of said stand up PWC foot well such that said seat assembly can be inserted into said stand up PWC footwell substantially locating said rectangular seating surface above said stand up PWC foot well, and b. a U-shaped hull structure comprising a bow and left and right side pods, each with predetermined shapes, volumes and density, forming an open bay area between thereof with interior surfaces contoured to the outer profile of said stand up PWC hull top deck and bond flange surfaces, the minimum distance between said left and right interior surfaces is predetermined by the maximum width of said stand up PWC such that said stand up PWC can be slidably inserted into said hull structure, and c. a connection system having at least one adjustable tension fastener, said fastener releasably attached at the rear of said hull structure left and right side pods and said fastener disposed upon rear of said rectangular base such that said fastener is planar when said seat base and said hull structure are combined with said stand up PWC.

2. The kit of claim 1 wherein said seat assembly extends forward of said seating surface forming a forward extension having a minimum elevation and maximum length such that when said seat assembly is inserted into said stand up PWC footwell said forward extension is located above said top deck and below said handle pole of said stand up PWC supporting said pole.

3. The kit of claim 1 wherein said assembly is longer than said stand up PWC footwell having a bottom surface contoured to fit in said PWC foot well such that when said seat assembly is inserted into said stand up PWC footwell a portion of said seat assembly is in contact with and extends behind said stand up PWC transom forming a rear deck.

4. The kit of claim 3 wherein said rear deck bottom surface has a minimum elevation such that when said seat assembly is inserted into said stand up PWC footwell said rear deck is substantially above said stand up PWC water jet exit.

5. The kit of claim 3 wherein said connection system further includes coordinated structures on to said rear deck and said hull left and right side pods mated together via adjustable tension fastener.

6. The kit of claim 3 wherein said rear deck provides a recess for attaching a retractable rear ladder.

7. The kit of claim 1 wherein said seat assembly and said hull structure are constructed from buoyant material.

8. The kit of claim 1 wherein said seating surface is releasably attached and said seat assembly forming an open cavity under said seating surface whereby providing accessible storage.

9. The kit of claim 1 wherein the bottom surface of said hull structure bow is disposed relative the installed location of said stand on PWC hull forming a continuous plane.

10. The kit of claim 1 wherein the length of said hull structure left and right side pods is predetermined so that when said hull structure is installed onto said stand up PWC said left and right side pods extend rearward of said stand up PWC hull transom forming rear extensions.

11. The kit of claim 10 wherein the bottom surfaces of said hull extensions are disposed to be substantially above said stand up PWC water jet exit when said stand up PWC is inserted into said hull structure.

12. The kit of claim 1 wherein the top surface of said hull assembly left and right side pods each include a footwell located and sized to provide a means for riders to support their feet when said kit is used in combination with said stand up PWC.

13. The kit of claim 1 wherein said hull structure interior surfaces include clearance channels providing locations for mounting an elastomeric material.

14. The kit of claim 1 wherein a top surface of said hull structure bow extends between said hull structure left and right side pods having sufficient elevation thereof such that said top surface covers the forward section of said stand up PWC when said stand up PWC is installed, said top surface further includes a formation of sufficient dimensions providing a location to mount a second steering and throttle control system.

15. A kit non-permanently attached to a stand up PWC, said stand up PWC comprising a water jet inlet, water jet exit, water jet propulsion means, hull, top deck, bond flange between said hull and top deck, foot well, and pivotably mounted handle pole, said kit comprising:

a. a hull structure consisting of a bow and left and right side pods having predetermined shapes, volumes and density, said bow extends partially under the front of and forms a tangent plane with a bottom surface of said stand up PWC hull, said left and right side pods extend along the port and starboard sides of said stand up PWC and are separated by a distance approximately equal the maximum width of said PWC, said side pods extend rearward beyond said stand up PWC hull transom forming extensions, the bottom of said extensions having a minimum elevation above said water jet exit, said bow and said left and right side pods having an inner surface shaped to mate with respective surfaces on the exterior of said stand up PWC, said inner surface having an integral channel encompassing said stand up PWC bond flange and having contact surfaces with said stand up PWC near the top and bottom edges and along the lower surface of said integral channel, such that said stand up, PWC can be slidably inserted between said hull side pods, whereby said hull assembly increases buoyancy and stability, and b. a seat assembly having a base and a padded surface releasably attached on top of said base, said base shaped to fit snugly into said stand up PWC foot well, having an open cavity under said padded surface, said base extends forward of said padded surface and above said top deck and below said pivotably mounted handle pole forming a support for said pivotably mounted handle pole, said assembly having a length greater than said stand up PWC foot well to extend rearward behind said stand up PWC bond flange and having a height, width and length whereby resulting structure forms a rear deck, the bottom surface of said rear deck having a minimum elevation above said water jet exit whereby said seat assembly provides a seat for multiple riders and increases buoyancy and storage, and c. a connection system having at least one adjustable tension fastener, said fastener releasably attached at the rear of said hull structure left and right side pods and said fastener disposed upon rear of said seat base such that said fastener is planar when said seat base and hull structure are combined with said stand up PWC.

16. The kit of claim 15 wherein said connection system includes coordinated structures on to said rear deck and said hull rear extensions such that said coordinated structures provide a means to redirect inboard motion of said hull structure side pods due to urging from said adjustable tension fastener.

17. The kit of claim 15 wherein said coordinated structures are male female surfaces molded onto said rear deck and said rear extensions located inline and sloped relative to said adjustable tension fastener.

* * * * *